US006537124B2

(12) United States Patent
Todokoro

(10) Patent No.: US 6,537,124 B2
(45) Date of Patent: Mar. 25, 2003

(54) FISHING TOY

(75) Inventor: Masatoshi Todokoro, Matsudo (JP)

(73) Assignee: Staff Co., Ltd., Tokyo (JP)

( * ) Notice: Subject to any disclaimer, the term of this patent is extended or adjusted under 35 U.S.C. 154(b) by 0 days.

(21) Appl. No.: 10/026,723

(22) Filed: Dec. 27, 2001

(65) Prior Publication Data

US 2003/0040251 A1 Feb. 27, 2003

(30) Foreign Application Priority Data

Aug. 21, 2001 (JP) ..... 2001-250256

(51) Int. Cl.[7] ..... A63H 23/00
(52) U.S. Cl. ..... 446/153; 446/158; 273/448
(58) Field of Search ..... 446/153, 154, 446/156, 158, 314–315, 330, 352, 353, 431, 454; 273/443, 447, 456, 459, 460, 448

(56) References Cited

U.S. PATENT DOCUMENTS

| | | | | |
|---|---|---|---|---|
| 3,077,698 A | * | 2/1963 | Glass et al. | |
| 4,270,307 A | * | 6/1981 | Arigaya | 46/254 |
| 4,832,650 A | * | 5/1989 | Tong | 446/156 |
| 5,050,876 A | * | 9/1991 | Chuang | 273/456 |
| 5,775,022 A | * | 7/1998 | Sumrall et al. | 43/3 |
| 6,022,025 A | * | 2/2000 | Chuang | 273/448 |
| 6,458,009 B1 | * | 10/2002 | Chuang | 446/315 |

FOREIGN PATENT DOCUMENTS

| | | | |
|---|---|---|---|
| JP | 11128554 | * | 5/1999 |
| JP | 200042243 | * | 2/2000 |
| JP | 2000254346 | * | 9/2000 |
| JP | 2001149637 | * | 6/2001 |

OTHER PUBLICATIONS www.vtech.com.*

* cited by examiner

*Primary Examiner*—Derris H. Banks
*Assistant Examiner*—Jamila Williams
(74) *Attorney, Agent, or Firm*—Swidler, Berlin, Shereff, Friedman, LLP

(57) ABSTRACT

A fishing toy comprising a fishing rod comprising in turn a handgrip portion to which the fishing rod is attached, a fishing line adapted to elongate via the fishing rod and a toy body fishing means attached to a distal end of the fishing line, and a toy body formed to mock fish and adapted to be fished up with the toy body fishing means, the toy body comprising a power supply, a driving means adapted to be driven with the power supply and an operation switch for varying the driven conditions of the driving means, the fishing toy being characterized in that;

the fishing rod has an operating means for varying the driving speed of the driving means provided on the toy body and a transmission means for transmitting operation information operated by the operating means to the toy body and that the toy body is provided with a reception means for receiving the information transmitted from the fishing rod.

6 Claims, 7 Drawing Sheets

FISHING TOY

BACKGROUND OF THE INVENTION

1. Field of the Invention

The present invention relates to a fishing toy.

2. Description of the Related Art

Conventionally, there has existed a fishing toy comprising a moving body adapted to move along a surface, a toy body adapted to be loosely fitted in a recessed portion formed in the moving body in such a manner as to be freely released, a toy body jumping mechanism for jumping the toy body up above the recessed portion and a fishing tool for fishing up the toy body with a bait or hook being caught or securely attracted with a magnetic force in the closed mouth of the toy body after the bait or hook has been inserted into or securely attracted with the magnetic force to the mouth opened when the toy body has jumped up from the bottom of the recessed portion.

In addition, there has existed a toy (refer to Japanese Unexamined Patent Publication No. 2000-42243) for producing the similar atmosphere to that of an actual fishing scene by designing an optionally moving fish-like toy body to violently trembling or vibrating entirely or partially when the toy body is caught on a fishing tool attached to a distal end of the fishing line. Furthermore, there has existed a toy (refer to Japanese Unexamined Patent Publication No. 2001-149637) for producing on a toy body visually twitching motions similar to those of fish seen when it is fished up by fluctuating a fishing line extending via a fishing rod so as to cause the toy body, which has been fished up, to tremble vertically and horizontally so that visual and physical feelings similar to those experienced when actual fish is fished up can be obtained when the toy body is fished up.

Thus, there have existed the toy which travels within a certain range and the toy which travels optionally and produces the feeling that would be felt when actual fish is fished up. However, the player tends to lose fun with the toy which only allows the player to fish the toy body moving within the certain range. Alternatively, with the toy which can move optionally, since the player cannot control the fish toy itself, the fish toy moves on its own and it sometimes happen to leave from the fishing range. Thus, the player cannot keep playing with the toy and due to this, he or she tends to lose fun at playing with the toy.

SUMMARY OF THE INVENTION

The present invention was made in view of the problems which are inherent in the prior art, and an object thereof is to provide a fishing toy which is difficult to be given up by the player by designing a toy body to tremble or vibrate to produce visual and physical feelings when the toy body is fished up which are similar to those felt when actual fish is fished up and allowing the toy body to be remote controlled so that the player can enjoy playing with the toy body not only as the fishing tool but also a toy that can be remote controlled.

According to a first aspect of the present invention, there is provided a fishing toy comprising a fishing rod comprising in turn a handgrip portion to which the fishing rod is attached, a fishing line adapted to elongate via the fishing rod and a toy body fishing means attached to a distal end of the fishing line, and a toy body formed to mock fish and adapted to be fished up with the toy body fishing means, the toy body comprising a power supply, a driving means adapted to be driven with the power supply and an operation switch for varying the driven conditions of the driving means, the fishing toy being characterized in that;

the fishing rod has an operating means for varying the driving speed of the driving means provided on the toy body and a transmission means for transmitting operation information operated by the operating means to the toy body and that the toy body is provided with a reception means for receiving the information transmitted from the fishing rod, whereby the propelling speed of the toy body can be varied by varying the driven conditions of the driving means based on the information transmitted from the fishing rod or information from the operating switch.

According to the construction of the first aspect of the present invention, the operating information from the player is transmitted from the operating means provided on the fishing rod via the transmission means and is received by the reception means on the toy body so that the driven conditions of the driving means can be varied. In short, the toy body can be remote controlled from the fishing rod.

According to a second aspect of the present invention, there is provided a fishing toy as set forth in the first aspect of the invention, wherein the toy body is a toy adapted to be played in water, the toy body being provided with a vertical rudder for propelling the toy body in vertical directions and a horizontal rudder for propelling the toy body in horizontal directions.

According to the construction of the second aspect of the present invention, by providing the vertical and horizontal rudders thereon the toy body adapted to be played in water can be steered to move in the vertical and horizontal directions.

According to a third aspect of the present invention, there is provided a fishing toy as set forth in the second aspect of the invention, wherein the vertical rudder is steered in advance so that the toy body submerges downwardly.

According to the construction of the third aspect of the present invention, with the vertical rudder being steered in advance in such a manner that the toy body submerges downwardly, when the toy body generates a certain propelling force, the vertical rudder is affected from a relationship with a buoyancy received by the toy body, and the toy body can perform submerging motions.

According to a fourth aspect of the present invention, there is provided a fishing toy as set forth in any of the first to third aspects of the invention, wherein the driving speed of the driving means on the toy body which is operated from the fishing rod is set so as to be operated to an optional propelling speed which is equal to or lower than a maximum driving speed.

According to the construction of the fourth aspect of the present invention, by setting the propelling speed of the toy body which can operated from the fishing rod so as to be operated to the optional propelling speed which is equal to or lower than the maximum driving speed the propelling speed can be clearly discriminated from the propelling speed resulting when the operation switch is activated.

According to a fifth aspect of the present invention, there is provided a fishing toy as set forth in the first aspect of the invention, wherein the toy body is a toy adapted to be played on a road surface, and wherein wheels are provided on the toy body which allows the toy body to run on the road surface, whereby the toy body can run on the road surface when operated from the fishing rod.

According to the construction of the fifth aspect of the present invention, the toy body is the toy that can be played on the road surface, and the wheels are provided on the toy body which allow the toy body to run on the road surface, whereby the play of fishing up the toy body can be played even on the road surface when the toy body is allowed to run on the road surface.

According to a sixth aspect of the present invention, there is provided a fishing toy as set forth in any of the first to fifth aspects of the invention, wherein the driving speed of the driving means on the toy body is made to reach its maximum when the operation switch is activated.

According to the construction of the sixth aspect of the present invention, by designing the driving speed of the driving means of the toy body to reach its maximum when the operation switch is activated the toy body is allowed to tremble or vibrate violently and the propelling speed of the toy body reaches the maximum speed, whereby an abrupt submerging motion can be produced in case the vertical rudder is steered in the direction in which the toy body is allowed to submerge as this occurs.

DESCRIPTION OF THE PREFERRED EMBODIMENT

In a case where a toy body is adapted to operate in water, there is provided a fishing toy comprising a fishing rod comprising in turn a handgrip portion to which the fishing rod is attached, a fishing line adapted to elongate via the fishing rod and a toy body fishing means attached to the distal end of the fishing line, and a toy body formed to mock fish and adapted to be fished up with the toy body fishing means, the toy body comprising a power supply, a driving means adapted to be driven with the power supply and an operation switch for varying the driven conditions of the driving means, the fishing toy being characterized in that;

the fishing rod has an operating means for varying the driving speed of the driving means provided on the toy body and a transmission means for transmitting operation information operated by the operating means to the toy body, and that the toy body is provided with a reception means for receiving the information transmitted from the fishing rod, a vertical rudder for propelling the toy body in vertical directions and a horizontal rudder for propelling the toy body in horizontal directions, the vertical rudder being steered in advance so that the toy body submerges downwardly.

In addition, the driving speed of the driving means on the toy body which is operated from the fishing rod is set so as to be operated to an optional propelling speed which is equal to or lower than a maximum driving speed, and the driving speed of the driving means on the toy body is made to reach its maximum when the operation switch is activated.

In a case where a toy body is adapted to operate on a road surface, there is provided a fishing toy comprising a fishing rod comprising in turn a handgrip portion to which the fishing rod is attached, a fishing line adapted to elongate via the fishing rod and a toy body fishing means attached to the distal end of the fishing line, and a toy body formed to mock fish and adapted to be fished up with the toy body fishing means, the toy body comprising a power supply, a driving means adapted to be driven with the power supply and an operation switch for varying the driven conditions of the driving means, the fishing toy being characterized in that;

the fishing rod has an operating means for varying the driving speed of the driving means provided on the toy body and a transmission means for transmitting operation information operated by the operating means to the toy body, and that the toy body is provided with a reception means for receiving the information transmitted from the fishing rod and wheels which allow the toy body to run on the road surface, so that the toy body is allowed to run on the road surface when operated from the fishing rod.

Embodiment

Figure 1:
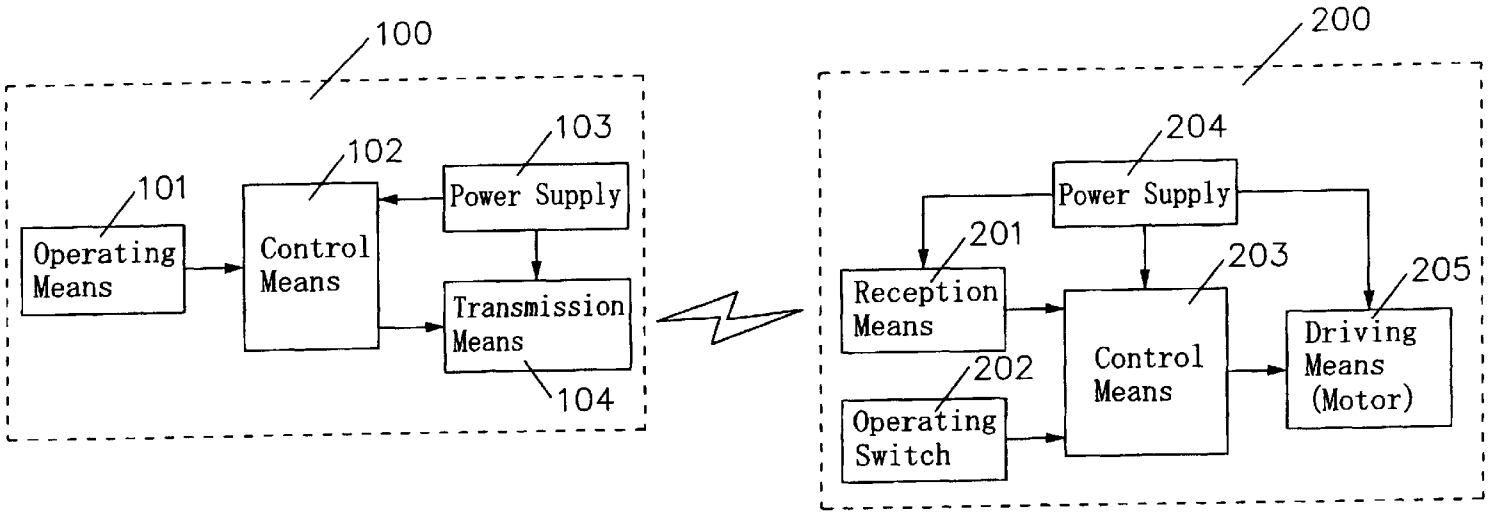
FIG. 1 is a block diagram showing a basic circuit configuration for a fishing toy according to the present invention.
Figure 2:
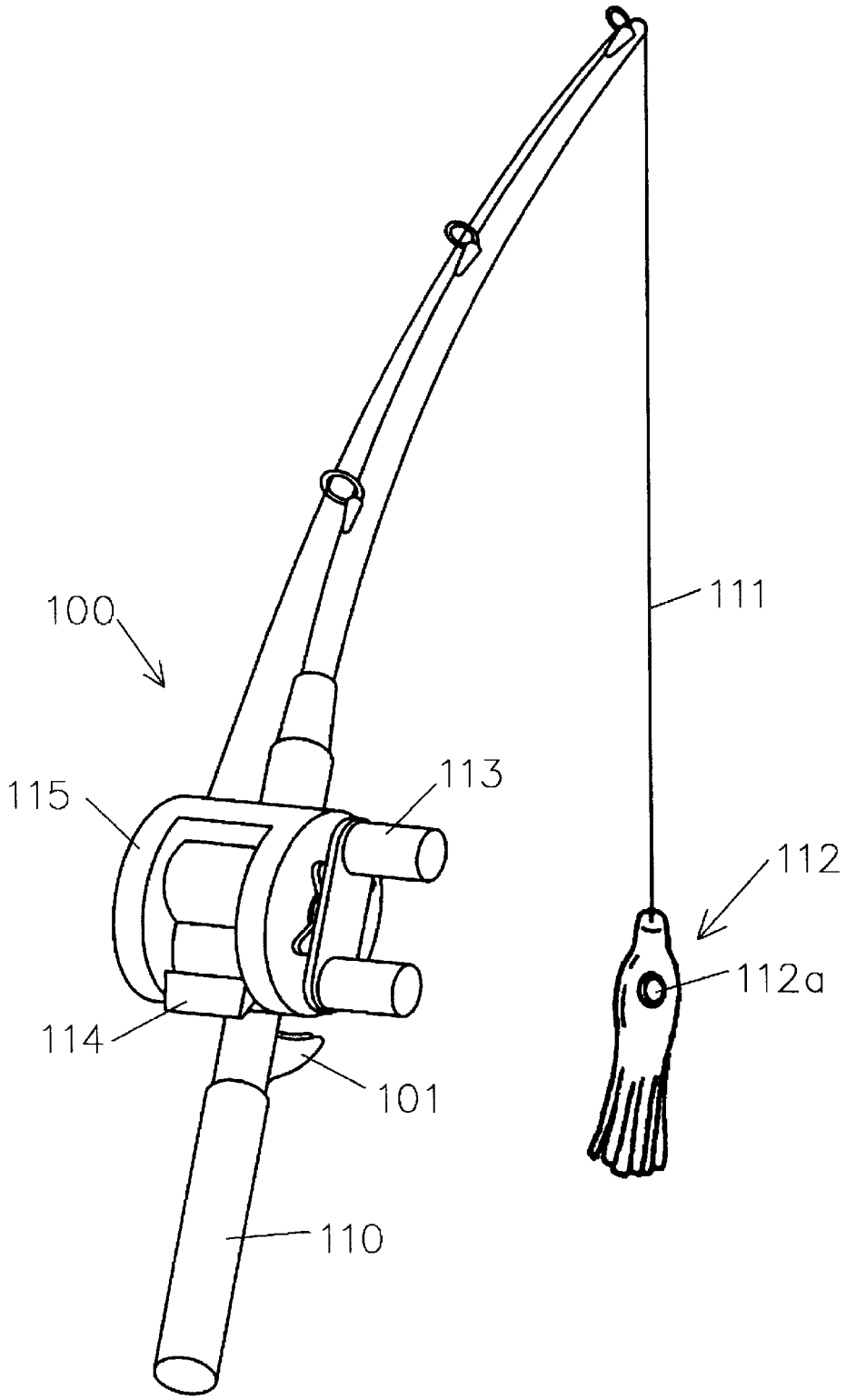
FIG. 2 is a diagram showing a fishing rod for the fishing toy according to the present invention.
Figure 3:
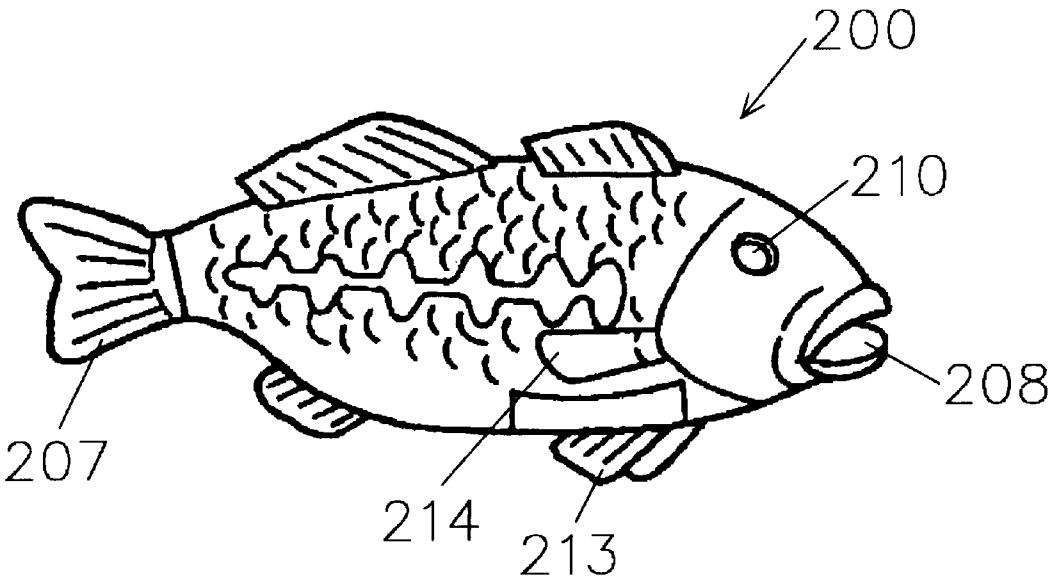
FIG. 3 is a diagram showing a fish toy body for the fishing toy according to the present invention.
Figure 4:
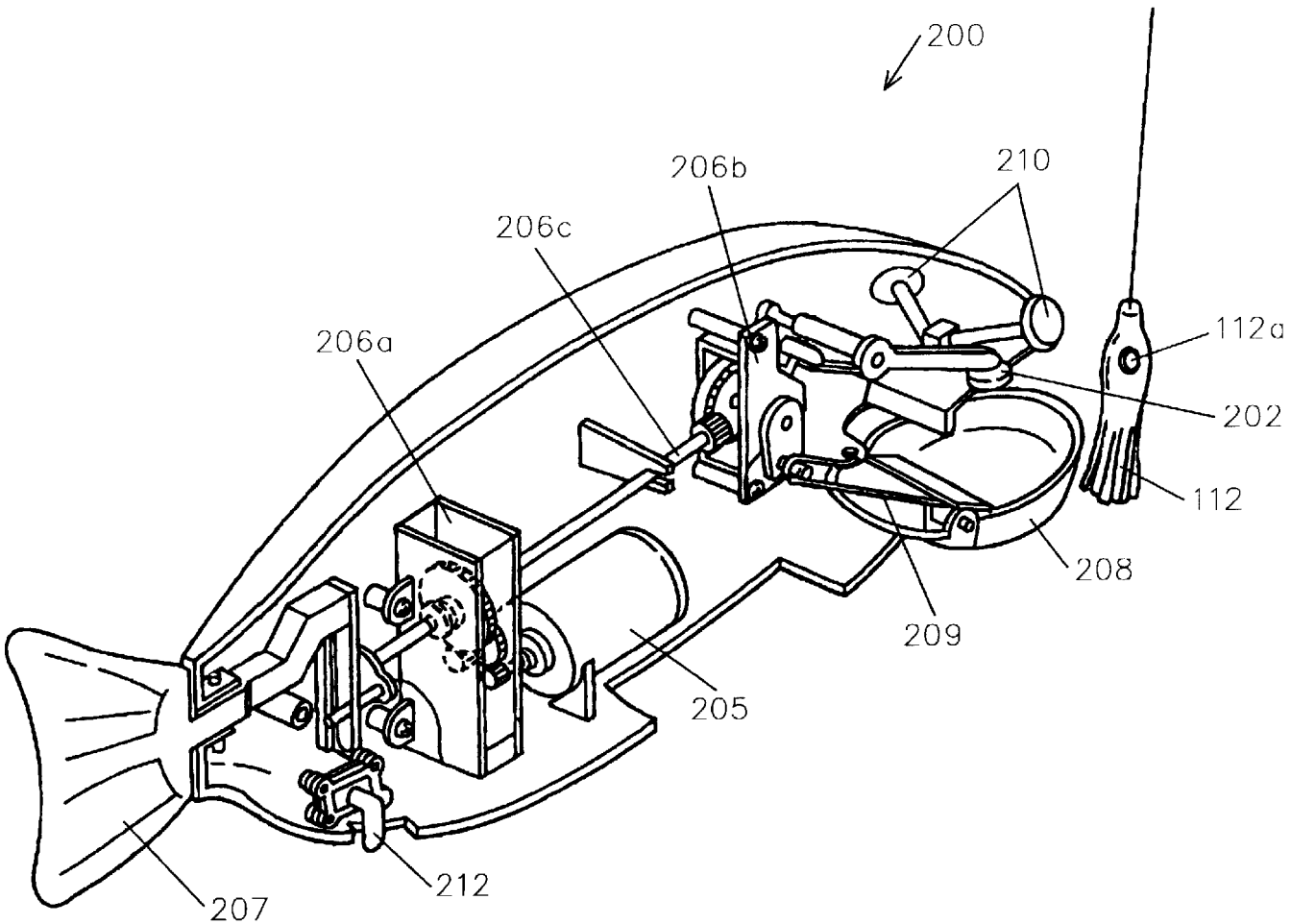
FIG. 4 is a perspective view showing the internal construction of the fish toy body for the fishing toy according to the present invention.
Figure 5:
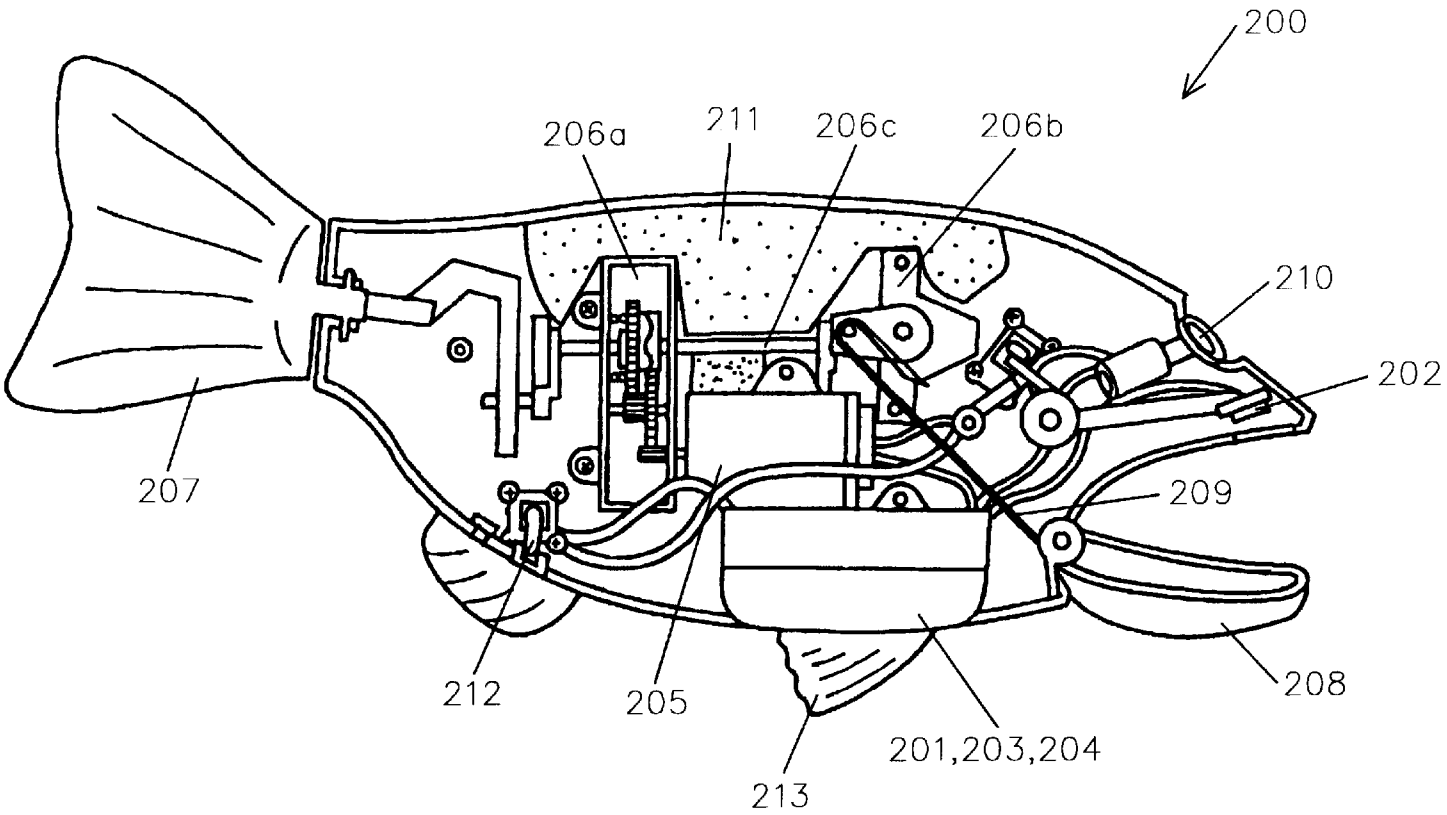
FIG. 5 is a front view showing the internal construction of the fish toy body for the fishing toy according to the present invention.

Referring to the appended drawings, an embodiment of the present invention will be described below. A fishing toy of an embodiment according to the present invention will be described with reference to FIGS. 1 to 4. FIG. 1 is a block diagram according to the embodiment of the invention. FIG. 2 shows an example of a fishing rod 100 for operating a fish toy body 200. FIG. 3 is a diagram showing the fish toy body 200, and FIGS. 4 and 5 are a perspective view and a front view, respectively, showing the internal construction of the fish toy body 200.

Firstly, the fishing rod 100 will be described. The fishing rod 100 comprises an operation means 101, a control means 102, a power supply 103 and a transmission means 104. In addition, the fishing rod 100 has a handgrip portion 110 that can be held by the hand of the player, a fishing line 111 elongating via the fishing rod, a toy fishing means 112 attached to a distal end of the fishing line and a magnetic body 112*a* provided on the toy fishing means for activating an operation switch 202 of a fish toy body 200. The outer configuration of a reel is constituted by a reel 115 in which the fishing line is taken up, a handle 113 for taking up the fishing line and a reel stopper 114 for temporarily fixing the fishing reel.

The operation means 101 is a variable switch for varying the propelling speed of the fish toy body and is formed into a trigger-like shape. A variable resistance value which interlocks with the trigger varies as the force with which the player presses on the trigger varies, and information on operation of the trigger is sent to the control means 102 as operation information.

The control means 102 processes suitably operation information sent from the operation means and transmits it to the transmission means 104. Depending on the type of the transmission means 104, it is desirable that the operation information is designed such that the information is sent to the transmission means of analog type in the form of analog signal whereas when sent to the transmission of digital type the information is converted into a digital signal for transmission thereto.

The power supply 103 supplies power to the entirety of the fishing rod 100. While it is desirable that a primary cell or a rechargeable secondary cell is used for the power supply 103, the household alternating-current power supply may be used.

The transmission means 104 is provided in the fishing rod and transmits operation information over electric wave to a reception means 201 provided in the fish toy body 200. In addition, a frequency band of 27 MHz or 40 MHz is desirably used for the electric wave. Furthermore, any of AM (amplitude modulation type), FM (frequency modulation type) and PCM (digital) may be used as the modulation system.

The fish toy body 200 will be described below. The fish toy body 200 is constituted by the reception means 201, an operation switch 202, a control means 203, a driving means 205 and a power supply 204. The fish toy body 200 consists of a first gear-type speed reduction mechanism 206*a* installed in the fish toy body 200, a second gear-type speed reduction mechanism 206*b* for moving a jaw portion 208 of the fish toy body, a central rotating shaft 206*c* for transmitting the driving of the first speed reduction mechanism 206*a* to the second speed reduction mechanism 206*b*, a connecting rod 209 for connecting the second speed mechanism 206*b* to the jaw portion 208 for transmitting the movement of the former to the latter, a light emitting portion 210 for illuminating the eyes of the fish toy body, a floating body 211 for obtaining buoyancy for the toy body and a power supply switch 212.

The reception means 201 receives operation information sent from the transmission means 104 of the fishing rod 100 and sends received information to the control means 203. The control means 203 transmits drive information to the driving means 205. In the embodiment, while not shown, a machine referred to as servo and having a rotating shaft which generates strong torque is installed in the fish toy body 200 and transmits drive information to the driving means 205. As the rotating shaft of the servo rotates a variable resistance connected to the driving means 205 for controlling the voltage varies, whereby the voltage varies and the driving speed of the fish toy body 200 is controlled. In addition, similarly, the rotation from the servo is transmitted to pelvic fins 213 (a horizontal rudder) and pectoral fins 214 (a vertical rudder) so as to move the pelvic fins 213 and the pectoral fins 214, whereby the traveling direction of the fish toy body 200 can freely be controlled.

The power supply 204 supplies power to the entirety of the fish toy body 200. It is desirable that a portable power supply means such as the primary cell or the secondary cell is used for the power supply. The operation switch 202 is provided in the interior of the mouth of the fish toy body 200 and is designed to be switched on when the magnetic body 112*a* provided on the toy fishing means 112 approaches the operation switch 202. In the embodiment, the jaw portion 208 of the fish toy body is operated by the second speed reduction mechanism 206*b*, whereby the jaw portion 208 performs a vertical motion. This vertical motion is converted into a biting motion of the mouth of the fish toy body 200, and the biting motion is designed to occur when the fish toy body 200 bites at the toy fishing means 112. In addition, it is constructed such that the gears of the second speed reduction mechanism 206*b* are disengaged from each other when the operation switch 202 is activated, and since the driving is halted, the jaw portion 208 is fixed in a state in which the mouth is closed.

The movement of the fish toy body 200 will be described. In order to steer the rudders so that the fish toy body turns, it is considered to employ a method for using the pelvic fins 213 and the like, a method for limiting the swinging movement of the caudal fin 207 to either the left or the right or a method for varying the driving speeds at which the caudal fin 207 is driven to the left and the right. Adopted in this embodiment is the method in which the pelvic fins 213 are used as the horizontal rudder. However, as has been described above, the method for varying the driving conditions of the caudal fin 207 may be adopted.

Furthermore, as a method for moving the fish toy body 200 in vertical directions, the following methods may be considered: a method for using an air bladder (a tank and a pump are provided in the fish toy body, and the balance between the weight and the buoyancy is varied by letting water in or out of the tank. When the tank is filled with water the weight exceeds the buoyancy, and therefore the fish toy body 200 submerges whereas when the tank is filled with air the buoyancy exceeds the weight and therefore the fish toy body floats); a method for using the lift by the fins (fins (formed into a wing-like shape) are provided on the fish toy body 200, and the fish toy body 200 moves vertically by making use of the lift by the fins. This method requires a propelling speed equal to or faster than a certain degree but has high response, whereby the fish toy body 200 can be moved in vertical directions); a method for making use of the lift of the entirety of the fish toy body (a mechanism is provided at the tail or head of the fish toy body 200 for forming an vertical angle, so that the entirety of the fish toy body 200 is deformed into a wing-like (segment-like) shape, whereby the fish toy body 200 can be moved in vertical directions by virtue of the lift obtained from the toy body so deformed); a method for varying the direction of the propelling force (a mechanism for angling the caudal fin 207 in a vertical direction is provided on the fish toy body 200 so that the orientation of the caudal fin 207 is varied, whereby the fish toy body 200 can be moved in vertical directions when it is driven in that state); a method for moving the center of gravity (a weight is provided within the fish toy body 200, and the posture of the fish toy body 200 is varied by moving the weight back and forth, whereby the fish toy body 200 can be moved in vertical directions by virtue of the propelling force of the caudal fin 207); and a method in which as has been described above, the posture of the fish toy body 200 is turned by moving the weight in the fish toy body horizontally, whereby the fish toy body 200 can be moved in vertical directions by virtue of the turning force of the caudal fin 207. In this embodiment, the method for making use of the lift by the fins is adopted. However, any of the methods that have been described above may be used.

The pectoral fins 214 (the vertical rudder) provided on the fish toy body 200 are set in advance in an orientation which allows the fish toy body 200 to move downwardly. A certain propelling force is required to allow the fish toy body to move downwardly by the action of the pectoral fins 214. Making use of this, by designing such that a certain magnitude of propelling force which does not allow the fish toy body to submerge is obtained at the time of normal operation, a magnitude of propelling force can be obtained which allows the fish toy body to submerge only by driving the caudal fin 207 at its maximum speed when the fish toy body is fished up, and the fish toy body also performs a submerging movement at the maximum propelling speed. In addition, when the fish toy body performs that movement the fish toy body abruptly moves away from the player.

Figure 6:
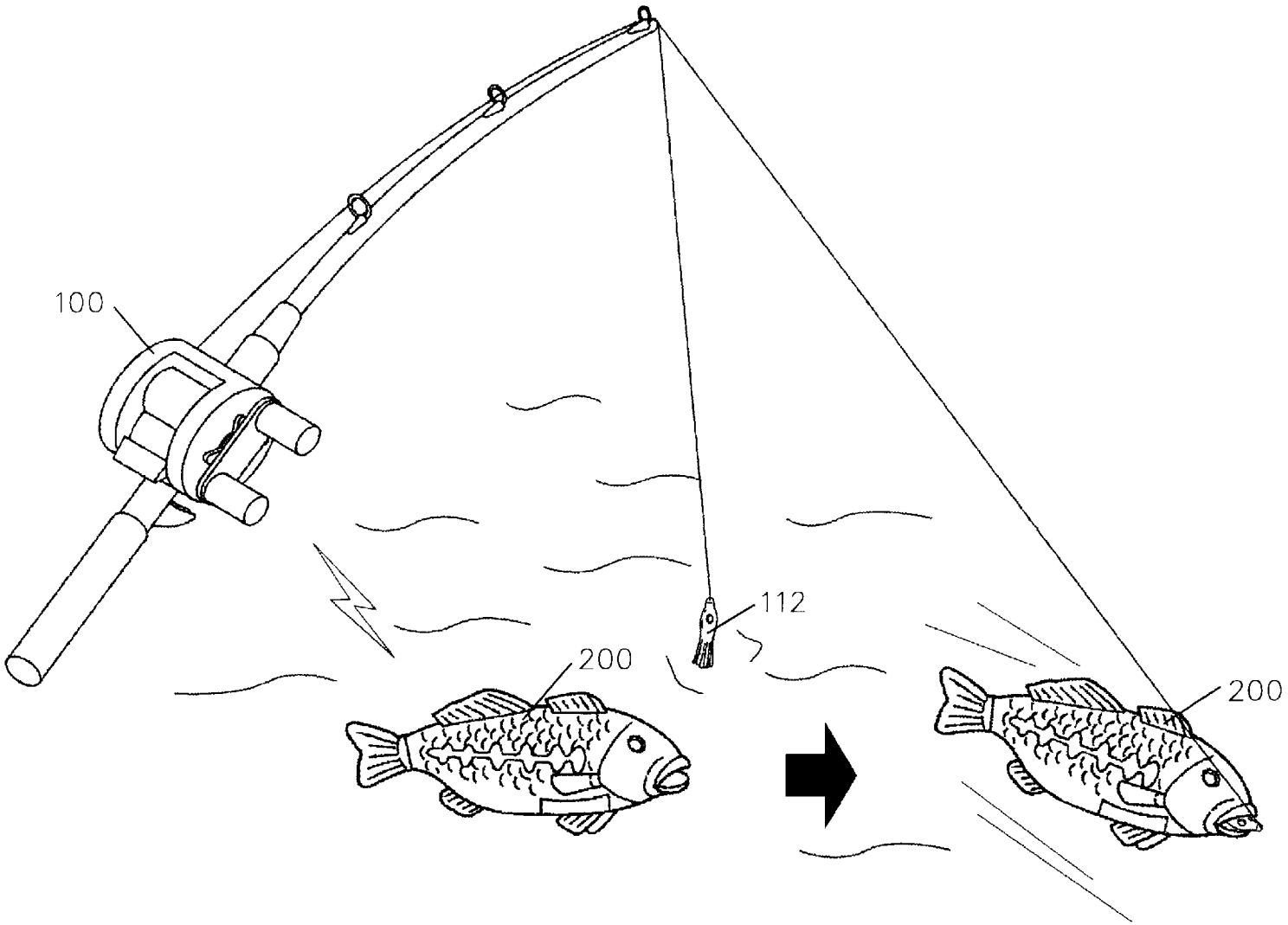
FIG. 6 is a diagram showing an example of how to play with the fishing toy according to the present invention.

Referring to FIG. 6, a method for using the fishing toy according to the embodiment will be described. Firstly, the fish toy body 200 is placed to float in a vinyl pool, a washtub or a bathtub. Then, water enters the interior of the fish toy body 200, but the fish toy body 200 can float in water with the assistance of the floating body 211 made of an expanded polystyrene foam. As this occurs, water does not penetrate into the driving means (motor) 205 and the power supply switch 212.

With the fish toy body being left in that condition, when the power supply switch 212 is slid to be switched on, the driving means 205 (the motor) moves slowly the caudal fin 207 in horizontal directions based on operation information from the fishing rod 100, whereby the fish toy body 200 starts to swim in or on water while moving its mouth as if fish were biting at its feed by moving the jaw portion 208 vertically. It is optional to illuminate of flash the light emitting diodes at the light emitting portions 210 as this occurs. In addition, as this occurs, if the pelvic fins 213 are twisted to one direction in advance, the fins function as rudders, and the fish toy body 200 swims slowly on water while drawing an arc corresponding to the angle through which the fins are twisted.

Then, the player holds the fishing rod 100 in his or her hand while operating the handle 113 to extend the fishing line 111 so that the toy fishing means 112 is guided closer to the mouth of the fish toy body 200 which is performing the feed-biting motion. When the toy fishing means 112 is introduced into the interior of the mouth the magnetic body 112*a* of the toy fishing means 112 is attracted to the operation switch 202 by virtue of magnetic attracting force and the operation switch 202 is switched on, whereby no operation information from the fishing rod 100 is received any more. As this occurs, the voltage of the driving means 205 (the motor) is varied to become its maximum, whereby the driving means 205 turns at high speed. Note that as this occurs, if the pelvic fins 213 are oriented in advance in a direction in which the fish toy body is allowed to submerge, the fish toy body performs a submerging motion. It is optional to illuminate or flash the light emitting diodes of the light emitting portions 210 or increase the intensity of the diodes which have already been illuminated of flashed.

From the above operation, the caudal fin 207 is made to swing more violently, and the vibrations of the caudal fin reach the hand of the player via the fishing line 111 and the fishing rod 100, whereby the player can experience trembling and heavy feelings transmitted to the hand of the player which are similar to those that would be experienced when real fish is fished up. In addition, on top of the play of fishing up the fish toy body, the player can enjoy allowing the fish toy body 200 to freely swim by remote controlling the same from the fishing rod 100. Thus, the fishing toy is a wonderful toy with which the player can enjoy himself or herself in both ways.

Being constructed as has been described heretofore, the present invention can provide the fishing toy which is difficult to be given up by the player and which is easy to play with. In addition, while the present invention has been described with reference to the preferred embodiment, the invention is not limited to the embodiment so described but may be modified variously without departing from the technical range determined by the scope of claims that will follow this description of the preferred embodiment.

Figure 7:
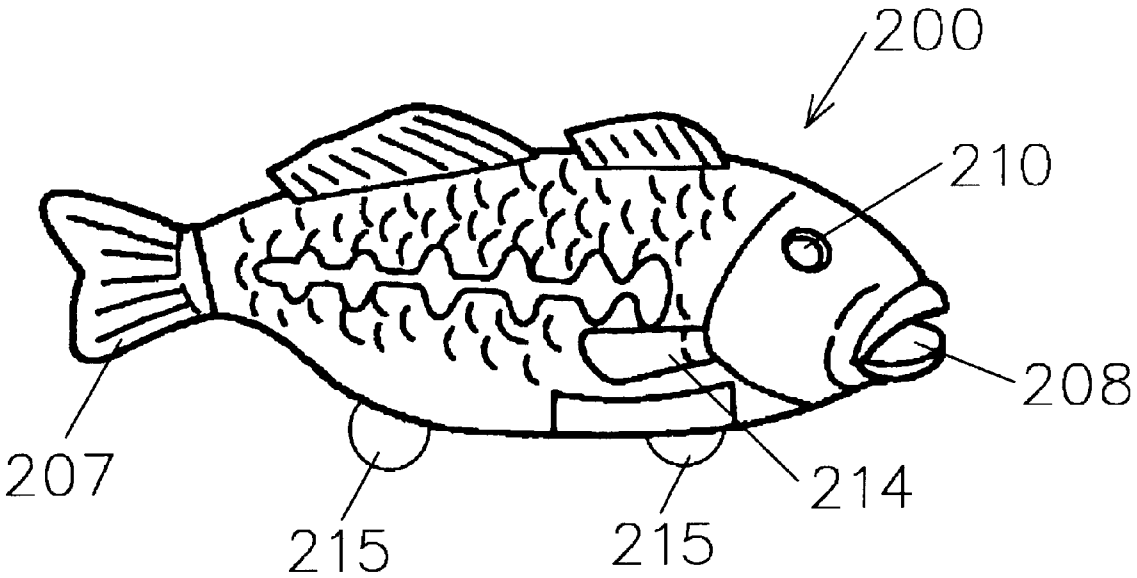
FIG. 7 is a diagram showing a fish toy body of the fishing toy according to the present invention when the fish toy body is used on a road surface.

For example, as shown in FIG. 7, at least one or more tires 215 for supporting the fish toy body 200 are provided underneath the fish toy body 200, so that the fishing toy is converted into a toy which can run on a road surface when driven by the driving means 205, whereby the player can enjoy remote controlling the fish toy body or fishing it up on the road surface.

Being implemented in the mode that has been described heretofore, the present invention provides the following advantages The operation information from the player is transmitted from the operating means provided on the fishing rod via the transmission means and is received by the reception means on the toy body, whereby the driven conditions of the driving means can be varied. In short, the toy body can be remote controlled from the fishing rod.

By providing the vertical and horizontal rudders on the toy body adapted to be played with in water, the toy body can be steered in vertical and horizontal directions.

With the vertical rudder being steered in advance in the direction in which the toy body is allowed to submerge, when a certain propelling force is applied to the toy body, the vertical rudder is affected due to the relationship with the buoyancy received by the toy body, whereby the toy body can perform a submerging movement.

By setting the propelling speed of the toy body that can be operated from the fishing rod so as to be operated to an optional propelling speed, the propelling speed can be discriminated clearly from the propelling speed when the operation switch is activated.

When converted into the toy that can be played with on the road surface, the wheels are provided on the toy body which allows the toy body to run on the road surface, whereby the toy body is allowed not only to run on the road surface but also to be fished up even on the road surface.

By allowing the driving speed of the driving means of the toy body to reach its maximum when the operation switch provided on the toy body is activated, the toy body violently trembles or vibrates and the propelling speed of the toy body reaches the maximum propelling speed, and as this occurs, in case the vertical rudder is steered in the direction in which the toy body is allowed to submerge, the abrupt submerging motion can be produced.

What is claimed is:

1. A fishing toy comprising a fishing rod comprising in turn a handgrip portion to which said fishing rod is attached, a fishing line adapted to elongate via said fishing rod and toy body fishing means attached to a distal end of said fishing line, and a toy body formed to mock fish and adapted to be fished up with said toy body fishing means, said toy body comprising a power supply, driving means adapted to be driven with said power supply and an operation switch for varying the driven conditions of said driving means, said fishing toy being characterized in that;

said fishing rod has operating means for varying the driving speed of said driving means provided on said toy body and transmission means for transmitting operation information operated by said operating means to said toy body and that said toy body is provided with reception means for receiving said information transmitted from said fishing rod, whereby the propelling speed of said toy body can be varied by varying the driven conditions of said driving means based on said information transmitted from said fishing rod or information from said operating switch.

2. A fishing toy as set forth in claim 1, wherein said toy body is adapted to be played in water, said toy body being provided with a vertical rudder for propelling said toy body in vertical directions and a horizontal rudder for propelling said toy body in horizontal directions.

3. A fishing toy as set forth in claim 2, wherein said vertical rudder is steered in advance so that said toy body submerges downwardly.

4. A fishing toy as set forth in claim 1, wherein the driving speed of said driving means on said toy body which is operated from said fishing rod is set so as to be operated to an optional propelling speed which is equal to or lower than a maximum driving speed.

5. A fishing toy as set forth in claim 1, wherein said toy body is adapted to be played on a road surface, and wherein wheels are provided on said toy body which allows said toy body to run on the road surface, whereby said toy body can run on the road surface when operated from said fishing rod.

6. A fishing toy as set forth in claim 1, wherein the driving speed of said driving means on said toy body is made to reach its maximum when said operating switch is activated.

* * * * *